US011691434B2

(12) United States Patent
Ogawa et al.

(10) Patent No.: US 11,691,434 B2
(45) Date of Patent: Jul. 4, 2023

(54) APPARATUS AND METHOD

(71) Applicant: CANON KABUSHIKI KAISHA, Tokyo (JP)

(72) Inventors: Hiroaki Ogawa, Kanagawa (JP); Yuki Omagari, Tokyo (JP); Akitoshi Yamada, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 94 days.

(21) Appl. No.: 17/481,051

(22) Filed: Sep. 21, 2021

(65) Prior Publication Data

US 2022/0097365 A1 Mar. 31, 2022

(30) Foreign Application Priority Data

Sep. 29, 2020 (JP) ..... JP2020-164107

(51) Int. Cl.
*B41J 2/32* (2006.01)
*B41J 2/355* (2006.01)

(52) U.S. Cl.
CPC ..... *B41J 2/32* (2013.01); *B41J 2/355* (2013.01)

(58) Field of Classification Search
CPC ..... B41J 2/32
See application file for complete search history.

(56) References Cited

U.S. PATENT DOCUMENTS

2003/0059085 A1 3/2003 Miyake
2004/0120544 A1 6/2004 Eguchi
2017/0187913 A1* 6/2017 Suzuki ..... B41M 5/382

FOREIGN PATENT DOCUMENTS

JP 2008030486 A 2/2008
JP 2013506582 A 2/2013

* cited by examiner

*Primary Examiner* — Justin Seo
(74) *Attorney, Agent, or Firm* — Canon U.S.A., Inc. IP Division

(57) ABSTRACT

An apparatus includes a generation unit and a multiplexing unit. The generation unit generates image data for recording by a forming apparatus that forms an image on a forming member using a print head that applies energy to the member. The multiplexing unit performs multiplexing processing to generate recording data in which predetermined information to be recognized by a reading apparatus as information different from an image to be recorded on the member is embedded in the image data.

18 Claims, 13 Drawing Sheets

FIG.9A

MASK FOR GENERATING 0

| | | | | | | | |
|---|---|---|---|---|---|---|---|
| 10 | 0 | 0 | -10 | -10 | 0 | 0 | 10 |
| 0 | 0 | -10 | -10 | 0 | 0 | 10 | 10 |
| 0 | -10 | -10 | 0 | 0 | 10 | 10 | 0 |
| -10 | -10 | 0 | 0 | 10 | 10 | 0 | 0 |
| -10 | 0 | 0 | 10 | 10 | 0 | 0 | -10 |
| 0 | 0 | 10 | 10 | 0 | 0 | -10 | -10 |
| 0 | 10 | 10 | 0 | 0 | -10 | -10 | 0 |
| 10 | 10 | 0 | 0 | -10 | -10 | 0 | 0 |

FIG.9B

MASK FOR GENERATING 1

| | | | | | | | |
|---|---|---|---|---|---|---|---|
| 10 | 0 | 0 | -10 | -10 | 0 | 0 | 10 |
| 10 | 10 | 0 | 0 | -10 | -10 | 0 | 0 |
| 0 | 10 | 10 | 0 | 0 | -10 | -10 | 0 |
| 0 | 0 | 10 | 10 | 0 | 0 | -10 | -10 |
| -10 | 0 | 0 | 10 | 10 | 0 | 0 | -10 |
| -10 | -10 | 0 | 0 | 10 | 10 | 0 | 0 |
| 0 | -10 | -10 | 0 | 0 | 10 | 10 | 0 |
| 0 | 0 | -10 | -10 | 0 | 0 | 10 | 10 |

PATTERN INDICATING 0

PATTERN INDICATING 1

APPARATUS AND METHOD

BACKGROUND OF THE DISCLOSURE

Field of the Disclosure

The aspect of the embodiments relates to an apparatus and a method.

Description of the Related Art

As image forming methods using thermal print heads, monochrome printing using thermal paper, color printing using ink ribbons, and the like have been used on the market. Japanese Unexamined Patent Application Publication (Translation of PCT Application) No. 2013-506582 and Japanese Patent Application Laid-Open No. 2008-030486 each discuss a recording method in which heat is applied to a sheet including color development layers for developing a plurality of colors to form a color image on the sheet. The color development layers for developing the plurality of colors are different from one another in terms of heating temperature and heating time for color development. By using the differences, the color of a specific image forming layer (color development layer) is developed to form a color image.

U.S. Patent Publication Application Nos. 2003/0059085 and 2004/0120544 each discuss an electronic watermark technique in which additional information such as audio information and text document information, which is different from image information, is multiplexed in an image to be recorded on a print product so that the additional information is not visually recognizable. The additional information is read, for example by using a scanner to scan the multiplexed print product.

In the recording methods discussed in Japanese Unexamined Patent Application Publication (Translation of PCT Application) No. 2013-506582 and Japanese Patent Application Laid-Open No. 2008-030486, since the color development layers are different in heating temperature and heating time for color development, sizes of color development regions of the color development layers vary with the same value data. In a case where such a recording method is used and additional information is embedded in an image as discussed in U.S. Patent Publication Application No. 2003/0059085 or 2004/0120544, the additional information embedded in the image may not be readable.

SUMMARY OF THE DISCLOSURE

According to an aspect of the embodiments, an apparatus includes a generation unit configured to generate image data for recording by a forming apparatus configured to form an image on a forming member using a print head configured to apply energy to the forming member, the forming member including a plurality of color development layers each having a different color development characteristic and configured to cause color development depending on the applied energy, and a multiplexing unit configured to perform multiplexing processing to generate recording data in which predetermined information to be recognized by a reading apparatus as information different from an image to be recorded on the forming member is embedded in the image data representing the image. The multiplexing unit generates the recording data so that the predetermined information is recorded by the color development of at least the color development layer that causes color development of a dot of one pixel in a shortest time among the plurality of color development layers in a case where the print head applies the energy to the forming member.

Further features of the disclosure will become apparent from the following description of exemplary embodiments with reference to the attached drawings.

BRIEF DESCRIPTION OF THE DRAWINGS

FIGS. 9A and 9B are diagrams each illustrating a mask pattern for multiplexing according to the exemplary embodiment.

DESCRIPTION OF THE EMBODIMENTS

Exemplary embodiments of the disclosure will be described in detail below with reference to the drawings. The configurations described below are mere examples and are not intended to limit the scope of the disclosure thereto.

[Image Forming Member]

Figure 1:
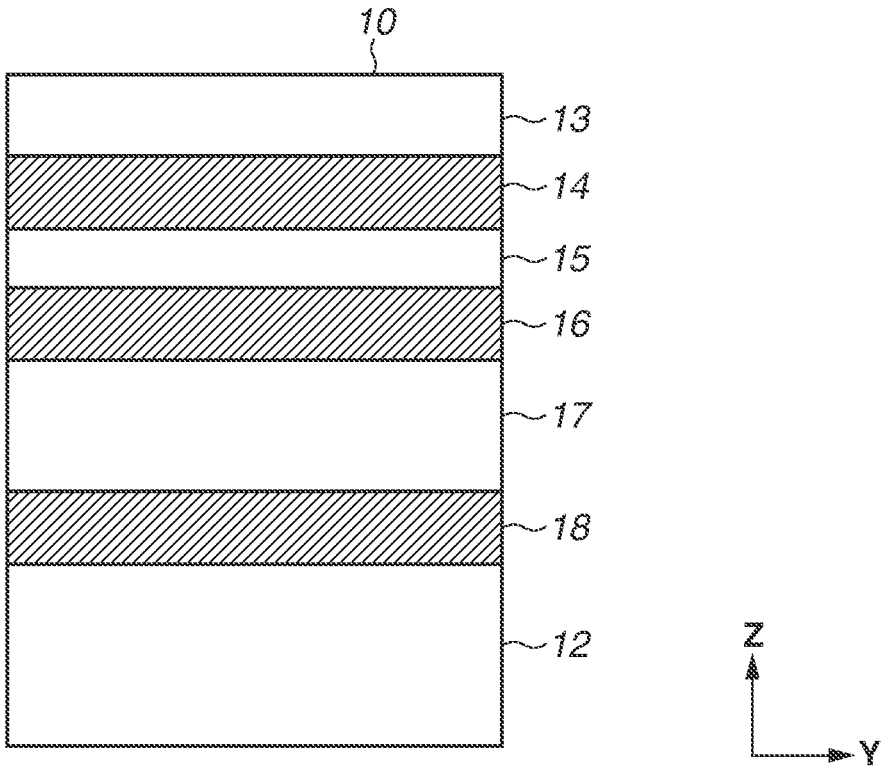
FIG. 1 is a diagram illustrating a configuration of an image forming member according to an exemplary embodiment of the disclosure.

FIG. 1 schematically illustrates a configuration of an image forming member 10 according to an exemplary embodiment of the disclosure. In the present exemplary embodiment, the image forming member 10 is heated to form an image thereon. While in the following description, resistors 34 (refer to FIGS. 3A and 3B) are used as the heat source, another heat source or another method such as infrared heating may be used.

Referring to FIG. 1, the image forming member 10 includes a substrate 12, an image forming layer 18, a spacer layer 17, an image forming layer 16, a spacer layer 15, an image forming layer 14, and a protection film layer 13 in this order from the bottom. The substrate 12 reflects light. In full-color printing, colors of the image forming layers 14, 16, and 18 are generally yellow, magenta, and cyan, respectively, but may be another combination of colors. In the example in FIG. 1, the image forming layers (color development layers) 14, 16, and 18 corresponding to three colors are provided, but more image forming layers may be provided.

Each of the image forming layers 14, 16, and 18 is colorless initially (before image formation). Each of the image forming layers 14, 16, and 18 changes to the corresponding color when heated to a specific temperature that is referred to as the activation temperature of the image forming layer. In the present exemplary embodiment, each of the image forming layers 14, 16, and 18 has a different color development characteristic for color development. The order of the colors of the image forming layers 14, 16, and 18 (the order of the image forming layers 14, 16, and 18) in the image forming member 10 can be selected as desired. A suitable order of the colors is as described above. Another suitable order is the order in which the colors of the three image forming layers 14, 16, and 18 are cyan, magenta, and yellow, respectively. In the present exemplary embodiment, the above-described configuration in which the colors of the image forming layers 14, 16, and 18 are yellow, magenta, and cyan, respectively will be described as an example. While in the example of FIG. 1, the image forming layers 14, 16, and 18 having the same thickness are stacked, the image forming layers 14, 16, and 18 are not limited to this example, and different thicknesses can be determined for different colors (color materials).

In addition, as illustrated in FIG. 1, the spacer layer 15 is provided between the image forming layers 14 and 16, and the spacer layer 17 is provided between the image forming layers 16 and 18. The thicknesses of the spacer layers 15 and 17 may be defined based on the color development characteristics of the image forming layers 14, 16, and 18, or thermal conductivity characteristics or thermal diffusivities of the image forming layers 14, 16, and 18. Furthermore, the spacer layers 15 and 17 may be formed of the same material or different materials. The function of the spacer layers 15 and 17 is to control thermal diffusion in the image forming member 10. In a case where the spacer layer 17 is formed of the same member as that of the spacer layer 15, in one embodiment, the spacer layer 17 is at least four times thicker than the spacer layer 15.

All the layers arranged on the substrate 12 are substantially transparent before image formation. In a case where the substrate 12 has a reflective color (e.g., white color), a color image formed on the image forming member 10 is visually recognized through the protection film layer 13 against a reflective background provided by the substrate 12. Since the layers on the substrate 12 are transparent, a person can visually recognize the combination of the respective colors printed on the image forming layers 14, 16, and 18.

While in the image forming member 10 according to the present exemplary embodiment, the three image forming layers 14, 16, and 18 are arranged on the same side of the substrate 12, some of the image forming layers 14, 16, and 18 may be arranged on the opposite side of the substrate 12.

In the present exemplary embodiment, the image forming layers 14, 16, and 18 are at least partially independently processed by changing two adjustable parameters of an image forming apparatus 40 (refer to FIG. 4), i.e., temperature and time. Controlling these parameters, more specifically, the temperature and time for a print head 30 (refer to FIG. 3A) to apply heat to the image forming member 10 enables image formation on a desired image forming layer. In other words, controlling the temperature and time for applying heat to the image forming member 10 enables color development with a desired density on a desired image forming layer.

In the present exemplary embodiment, each of the image forming layers 14, 16, and 18 is processed by the print head 30 applying heat while being in contact with an uppermost layer of the image forming member 10, i.e., the protection film layer 13 illustrated in FIG. 1. The color development characteristics of the image forming layers 14, 16, and 18 according to the present exemplary embodiment will be described next. Assuming that the activation temperatures of the image forming layers 14, 16, and 18 are Ta3, Ta2, and Ta1, respectively, the activation temperature Ta3 of the image forming layer 14 is higher than the activation temperature Ta2 of the image forming layer 16 and is also higher than the activation temperature Ta1 of the image forming layer 18. A relationship among the activation temperatures Ta3, Ta2, and Ta1 (the color development characteristics) of the image forming layers 14, 16, and 18 will be described below with reference to FIG. 2.

Heating of the image forming layers 16 and 18 located further away from the print head 30 (i.e., the protection film layer 13) is delayed because the heat from the print head 30 is conducted and diffused to the image forming layers 16 and 18 through the spacer layer 15 and/or the spacer layer 17. Thus, even in a case where the temperature of the heat applied from the print head 30 to the surface (i.e., the protection film layer 13) of the image forming member 10 is substantially higher than the activation temperatures Ta2 and Ta1 of the image forming layers 16 and 18 located at lower positions (located further away from the print head 30), the heating delay due to the heat diffusion in each of the image forming layers 16 and 18 makes it possible to heat the image forming layer 14 closer to the print head 30 to the activation temperature Ta3 while the image forming layers 16 and 18 at lower positions are controlled not to be activated. Thus, in processing (color development) of the image forming layer 14 closest to the protection film layer 13, the print head 30 heats the image forming layer 14 to a relatively high temperature (which is the activation temperature Ta3 or higher) for a short time. At this time, the heating is insufficient for both the image forming layers 16 and 18, so that neither of the image forming layers 16 and 18 causes color development (neither of the image forming layers 16 and 18 is activated).

Activation of an image forming layer closer to the substrate 12 (the image forming layer 16 or 18 in this example) is achieved by application of heat at a temperature lower than the activation temperature of the image forming layer further away from the substrate 12 (e.g., the image forming layer 14) for a sufficiently long time. The activation of the image forming layer (e.g., the image forming layer 16 or 18) at a lower position in this manner does not cause the activation of the image forming layer (e.g., the image forming layer 14) at a higher position.

In one embodiment, the thermal print head 30 is used to heat the image forming member 10. Alternatively, another method may be used. For example, a known method such as a method using a modulated light source (e.g., a laser) may be used.

[Color Development Characteristics]

Figure 2:
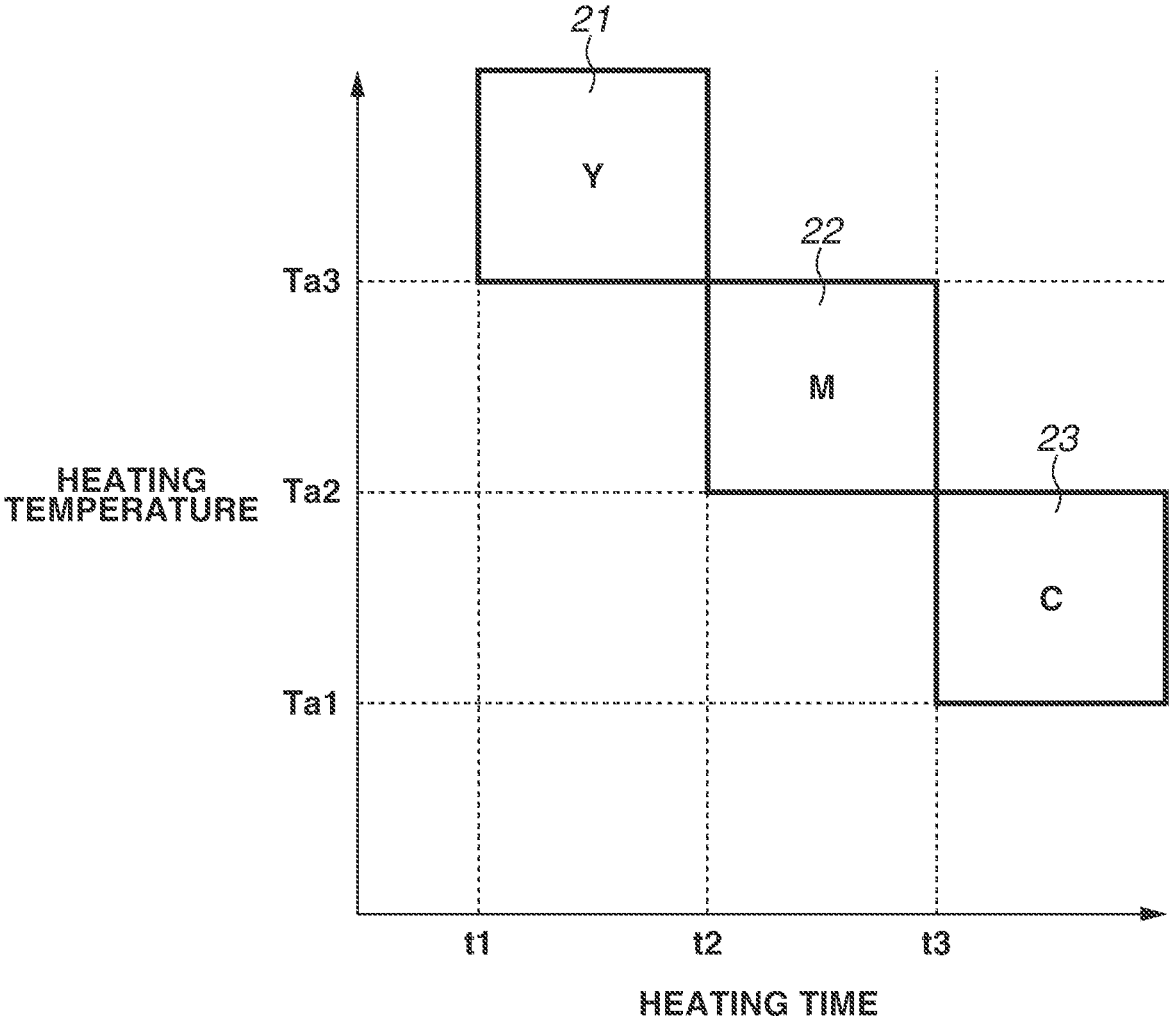
FIG. 2 is a diagram illustrating a relationship between a heating temperature and a heating time according to the exemplary embodiment.

FIG. 2 illustrates the relationship among heating temperatures and heating times for processing the image forming layers 14, 16, and 18 of the image forming member 10. In FIG. 2, the vertical axis represents the heating temperature at the surface of the image forming member 10 being in contact with the print head 30, and the horizontal axis represents the heating time. In the following description, it is assumed that the heating temperature is the same as the temperature of the heat to be applied by the print head 30.

A region 21 represents a relatively high heating temperature and a relatively short heating time. In the present exemplary embodiment, the region 21 corresponds to the yellow color of the image forming layer 14. More specifically, in a case where energy indicated by the region 21 is fed to the image forming layer 14, the image forming layer 14 causes color development (image formation). A region 22 represents an intermediate heating temperature and an intermediate heating time. The region 22 corresponds to the magenta color of the image forming layer 16. More specifically, in a case where energy indicated by the region 22 is fed to the image forming layer 16, the image forming layer 16 causes color development (image formation). A region 23 represents a relatively low heating temperature and a relatively long heating time. The region 22 corresponds to the cyan color of the image forming layer 18. More specifically, in a case where energy indicated by the region 23 is fed to the image forming layer 18, the image forming layer 18 causes color development (image formation). The time for the image forming layer 18 to cause image formation (color development) is substantially longer than the time for the image forming layer 14 to cause image formation.

In one embodiment, the activation temperatures Ta3, Ta2, and Ta1 of the image forming layers 14, 16, and 18 are selected from, for example, the range of about 90° C. to about 300° C. The activation temperature Ta1 of the image forming layer 18 is to be as consistently low as possible with respect to thermal stability of the image forming member 10 during shipment and storage, and be more specifically about 100° C. or higher. The activation temperature Ta3 of the image forming layer 14 is to be as consistently high as possible with respect to the activation temperatures Ta2 and Ta1 of the image forming layers 16 and 18 that are activated by heating through the image forming layer 14, and be more specifically about 200° C. or higher. The activation temperature Ta2 of the image forming layer 16 is between Ta1 and Ta3 (i.e., between about 140° C. to about 180° C.).

Even in a case where the energy within the corresponding region is applied to each of the image forming layers 14, 16, and 18, the density of the color formed thereon varies depending on the position of the energy in the region. For example, in a case where the energy in the region 22 is applied to the image forming layer 16, an image with a higher density is formed when a temperature closer to the activation temperature Ta3 is applied than when a temperature closer to the activation temperature Ta2 is applied with the same heating time. The same also applies to a case where the heating time is changed.

[Print Head]

The print head 30 according to the present exemplary embodiment includes a substantially linear array of the resistors 34 extending along the entire width of an image. In the present exemplary embodiment, the print head 30 extends in a direction perpendicular to a conveyance direction of the image forming member 10 (i.e., the print head 30 extends in a width direction of the image forming member 10), and the resistors 34 are provided along the width direction. The width of the print head 30 may be shorter than an image. In this case, the print head 30 may be moved relative to the image forming member 10 or may be used in combination with another print head in order to process the entire width of the image.

When an electric current is fed to the resistors 34 of the print head 30, the resistors 34 operate as the heat source. The image forming member 10 is conveyed while receiving heat from the resistors 34, so that image formation is performed in each of the image forming layers 14, 16, and 18. The time during which heat is applied to the image forming member 10 by the print head 30 is typically in the range of about 0.001 milliseconds to about 100 milliseconds per line of an image. The upper limit is set based on a balance with the print time, whereas the lower limit is defined by a constraint of an electronic circuit (not illustrated). The intervals of dots that form an image are generally in the range of 100 lines per inch to 600 lines per inch in each of the conveyance direction and the width direction of the image forming member 10. Alternatively, the intervals in the conveyance direction and the intervals in the width direction may be different from each other.

Figure 3A:
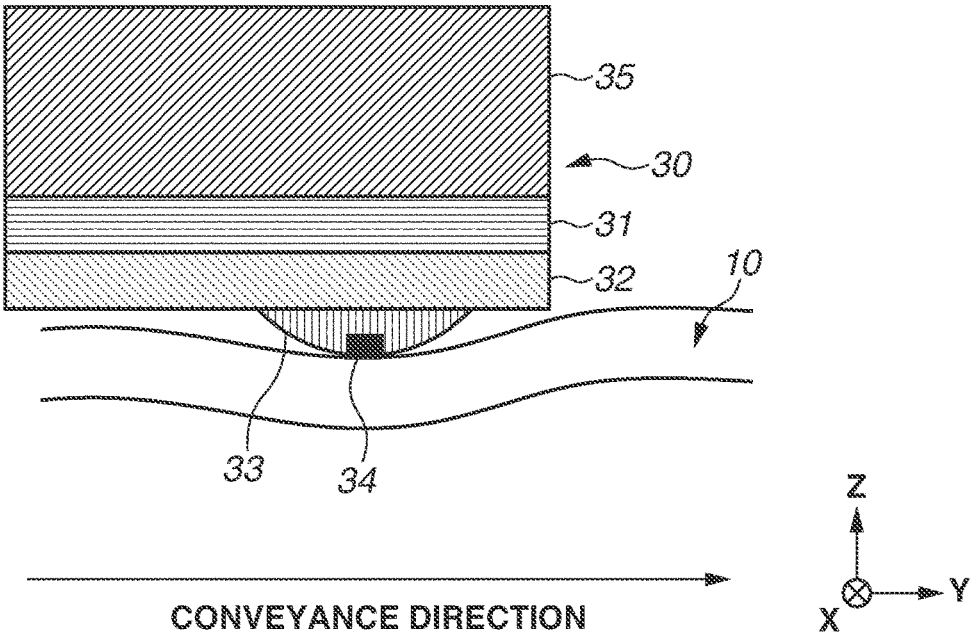
FIGS. 3A and 3B are diagrams illustrating a configuration of a print head and the image forming member according to the exemplary embodiment.
Figure 3B:
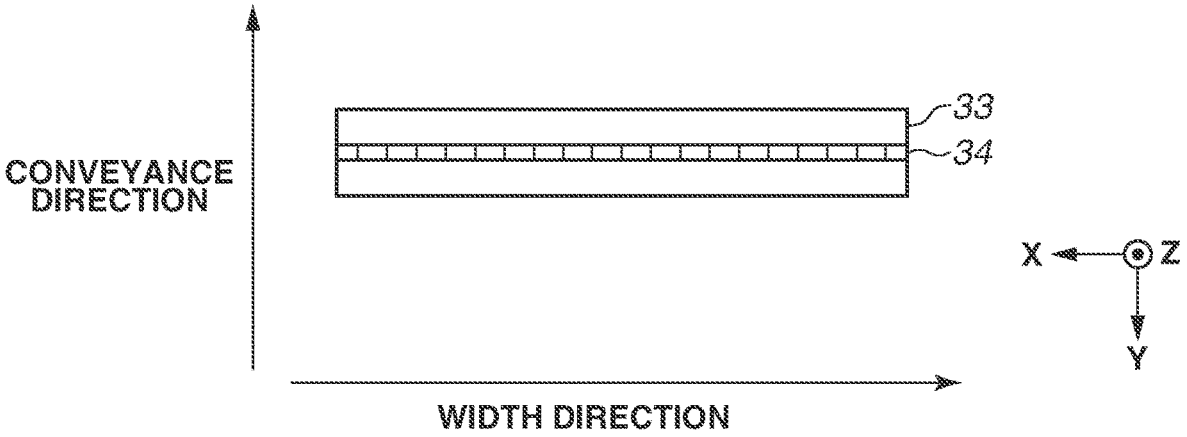

FIGS. 3A and 3B illustrate an example of a configuration of the print head 30 and the image forming member 10 during image formation according to the present exemplary embodiment. It is assumed in FIG. 3A that the image forming member 10 is conveyed in a rightward direction during image formation. In addition, the above-described width direction of the image forming member 10 corresponds to a depth direction in FIG. 3A. The print head 30 includes a glaze 32 on a base 31. Furthermore, in the present exemplary embodiment, the glaze 32 includes a convex glaze 33. The resistors 34 are arranged on the surface of the convex glaze 33 so as to come into contact with the image forming member 10 being conveyed in the conveyance direction. The convex glaze 33 may have another shape, or may not be provided. Even in this case, the resistors 34 are arranged so as to come into contact with the image forming member 10. In one embodiment, a protection film layer (not illustrated) is formed on the resistors 34, the glaze 32, and the convex glaze 33. A combination of the glaze 32 and the convex glaze 33 that are generally made of the same material will be hereinafter referred to as "the glaze of the print head 30".

The base 31 and a heatsink 35 are provided on the glaze 32. The base 31 is in contact with the heatsink 35 and is cooled by a cooling unit such as a fan (not illustrated). The image forming member 10 generally comes into contact with the glaze of the print head 30 that is longer than the length of the resistors (heating resistors) 34 in the conveyance direction. The resistors 34 typically has a length of about 120 microns in the conveyance direction of the image forming member 10, whereas a thermal contact region of the image forming member 10 that comes into thermal contact with the glaze of the print head 30 is generally 200 microns or more.

FIG. 3B illustrates an arrangement example of the resistors 34 in the width direction. The resistors 34 are arranged in plural numbers in the width direction to have a certain length with respect to the width direction of the image forming member 10. One line of an image is formed along this arrangement. In an example to be described below, an image is assumed to be formed line by line while the image forming member 10 is conveyed in the conveyance direction.

[Image Forming Apparatus]

Figure 4:
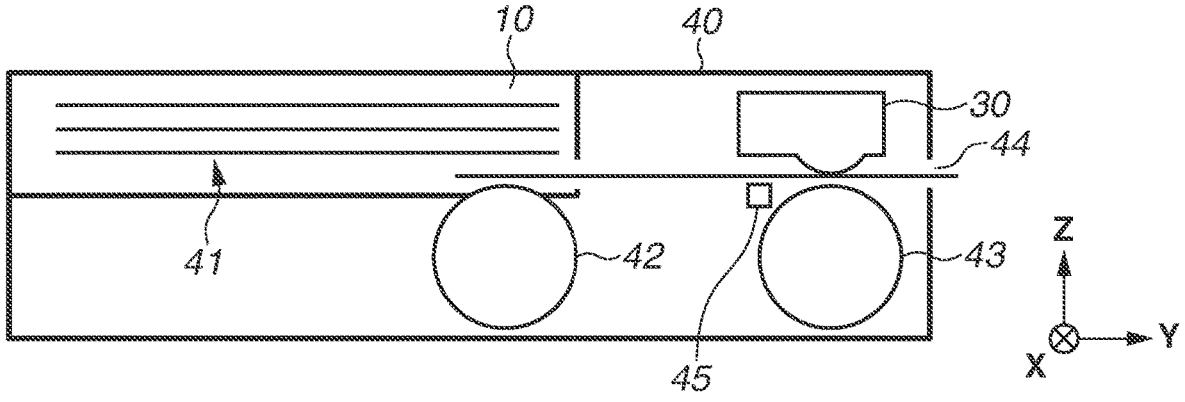
FIG. 4 is a diagram illustrating an example of a configuration of an image forming apparatus according to the exemplary embodiment.

FIG. 4 is a cross-sectional view illustrating an example of a configuration of the image forming apparatus 40 according to the present exemplary embodiment. The image forming apparatus 40 includes therein the print head 30, a storage unit 41, a conveyance roller 42, a platen 43, a discharge port 44, and a temperature sensor 45. The storage unit 41 can store a plurality of the image forming members 10. Opening and closing a cover (not illustrated) of the storage unit 41 enables replenishment of the image forming member 10. During printing, the image forming member 10 is conveyed to the print head 30 by the conveyance roller 42 to form an image on the image forming member 10 between the platen 43 and the print head 30. The image forming member 10 is then discharged from the discharge port 44, so that the printing is completed. In addition, the temperature sensor 45 is provided near a nip portion between the print head 30 and the platen 43, and detects the temperature of the heat applied from the print head 30. The target of detection by the temperature sensor 45 may be, for example, the temperature of the resistors 34 (heat source) of the print head 30 or may be the surface temperature of the image forming member 10. In addition, the temperature sensor 45 is not limited to a configuration for detecting the temperature of one area and may be a configuration for detecting the temperatures of a plurality of areas. Furthermore, the temperature sensor 45 may be configured to detect the ambient temperature of the image forming apparatus 40.

A conveyance speed of the image forming member 10 is controlled based on an image forming speed, an image forming resolution, and the like. For example, the conveyance speed may be set to be lower in a case where a high-resolution image is formed than in a case where a low-resolution image is formed. Furthermore, in a case where the print speed is prioritized, the conveyance speed may be increased and the resolution may be decreased.

[System Configuration]

Figure 5:
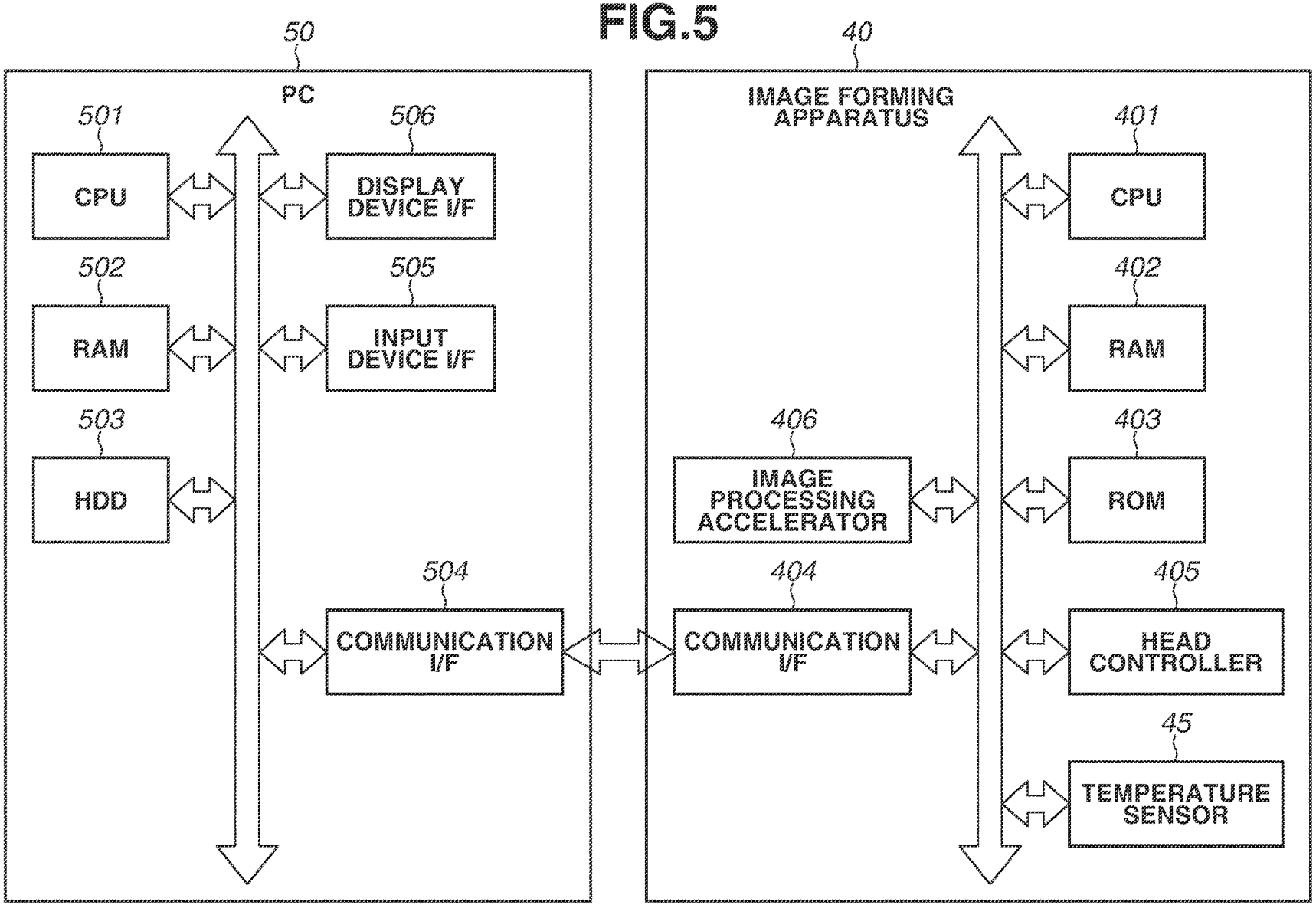
FIG. 5 is a diagram illustrating an entire configuration of a system according to the exemplary embodiment.

FIG. 5 illustrates an example of an entire configuration of a system according to the present exemplary embodiment. As illustrated in FIG. 5, the system according to the present exemplary embodiment includes the image forming apparatus 40 illustrated in FIG. 4 and a personal computer (PC) 50 as a host apparatus of the image forming apparatus 40.

The PC 50 includes a central processing unit (CPU) 501, a read-only memory (RAM) 502, a hard disk drive (HDD) 503, a communication interface (I/F) 504, an input device I/F 505, and a display device I/F 506. The foregoing components of the PC 50 are communicably connected to one another via an internal bus. The CPU 501 performs processing based on a program and various types of data that are stored in the HDD 503 or the RAM 502. The RAM 502 is a volatile storage that temporarily stores programs and data. The HDD 503 is a non-volatile storage that stores programs and data.

The communication I/F 504 controls communication with an external apparatus, and controls transmission and reception of data to and from the image forming apparatus 40 in this example. A connection method for the data transmission and reception is a wired connection via a universal serial bus (USB), an Institute of Electrical and Electronics Engineers (IEEE) 1394 serial bus, a local area network (LAN) or the like, or a wireless connection such as a Bluetooth® or WiFi® connection. In the present exemplary embodiment, image data to be used by the image forming apparatus 40 to perform recording is transmitted from the PC 50 to the image forming apparatus 40 via the communication I/F 504.

The input device I/F 505 controls a human interface device (HID) such as a keyboard or a mouse and receives a user's input via an input device. The display device I/F 506 controls display on a display device such as a display (not illustrated).

The image forming apparatus 40 includes a CPU 401, a RAM 402, a ROM 403, a communication I/F 404, a head controller 405, an image processing accelerator 406, and the temperature sensor 45. The foregoing components of the image forming apparatus 40 are communicably connected to one another via an internal bus. The CPU 401 performs each processing (described below) according to the present exemplary embodiment based on a program and various types of data that are stored in the ROM 403 or the RAM 402. The RAM 402 is a volatile storage that temporarily stores programs and data. The ROM 403 is a non-volatile storage that stores table data and programs for use in the processing to be described below.

The communication I/F 404 controls communication with an external apparatus, and controls transmission and reception of data to and from the PC 50 in this example. The head controller 405 controls a heating operation of the print head 30 illustrated in FIGS. 3A and 3B, based on recording data. More specifically, the head controller 405 can be configured to read a control parameter and the recording data from a predetermined address of the RAM 402. When the CPU 401 writes the control parameter and the recording data to the predetermined address of the RAM 402, the head controller 405 activates processing, and the print head 30 performs the heating operation.

The image processing accelerator 406 is formed of hardware and performs image processing at a higher speed than that of the CPU 401. More specifically, the image processing accelerator 406 can be configured to read parameters and data for image processing from a predetermined address of the RAM 402. When the CPU 401 writes the parameters and the data to the predetermined address of the RAM 402, the image processing accelerator 406 is activated to perform predetermined image processing. The image processing accelerator 406 is not an essential component. The image processing may be performed by processing by the CPU 401, depending on printer specifications. As illustrated in FIG. 4, the temperature sensor 45 detects the ambient temperature of the resistors 34 of the print head 30 and provides information about the temperature to the CPU 401. The CPU 401 generates a control parameter for controlling heat generation of the resistors 34, based on the acquired temperature information. Details of the control will be described below.

While the image forming apparatus 40 and the PC 50 have been described as separate apparatuses in the present exemplary embodiment, for example, a system in which the image forming apparatus 40 and the PC 50 are integrated together or a system in which the image forming apparatus 40 and an image capturing apparatus (not illustrated) are integrated together may be employed. Furthermore, while the PC 50 has been described as an example of the host apparatus, the host apparatus is not limited thereto, and a mobile terminal such as a smartphone, a tablet terminal, or an image capturing apparatus may be used.

Figure 6:
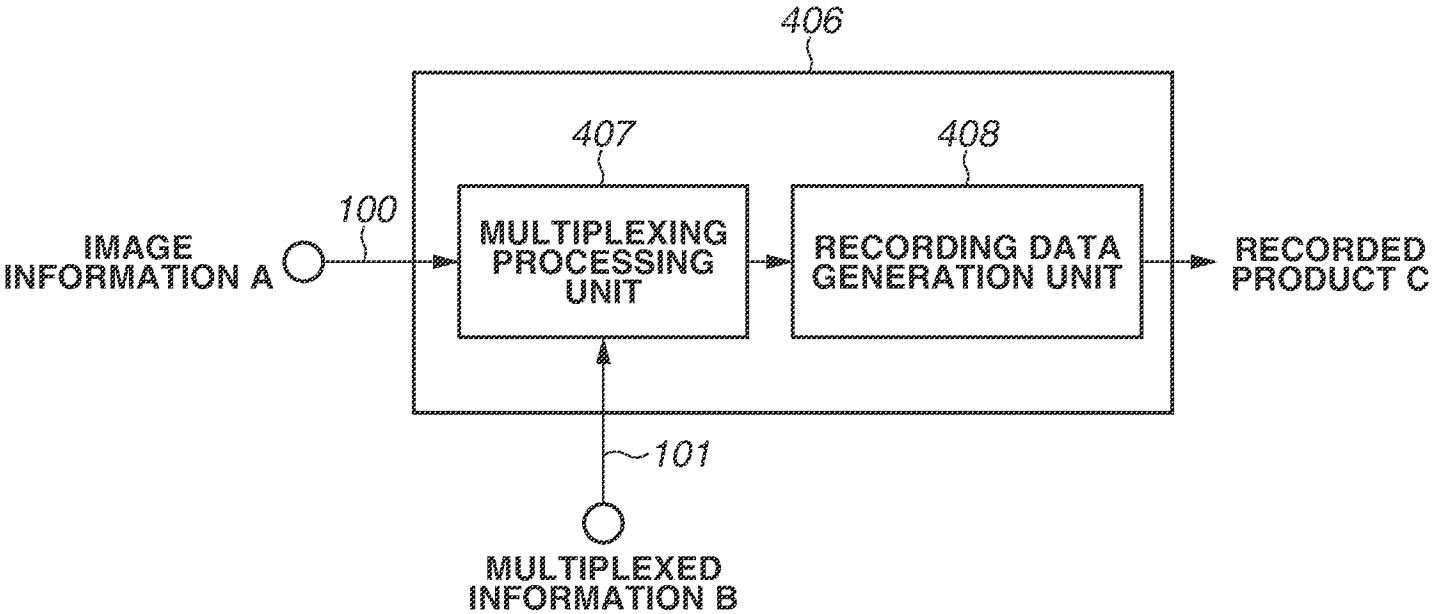
FIG. 6 is a diagram illustrating a method for forming an image including multiplexed information according to the exemplary embodiment.

A method for forming an image including multiplexed information will be described next with reference to FIG. 6. The image processing accelerator 406 includes a multiplexing processing unit 407 and a recording data generation unit 408 as illustrated in FIG. 6. Image information A, which is information about the image to be recorded, is input via an input terminal 100 to the multiplexing processing unit 407. Multiplexed information B, which is information to be embedded in the image, is input via an input terminal 101 to the multiplexing processing unit 407. The multiplexing processing unit 407 outputs the image information A with the multiplexed information B added thereto. The output image information A with the multiplexed information B added thereto is input to the recording data generation unit 408. The recording data generation unit 408 generates recording data indicating whether to apply heat for each pixel. The print head 30 performs the heating operation on the image forming member 10 based on the generated recording data, so that the image is recorded on the image forming member 10 and the recorded image is output as a recorded product C.

Multiplexing may be performed by the CPU 501 of the PC 50 or by the CPU 401 of the image forming apparatus 40. In this case, the number of terminals via which information is input may be more than one. Details of the multiplexing processing unit 407 will be described below.

[Print Service]

Figure 7:
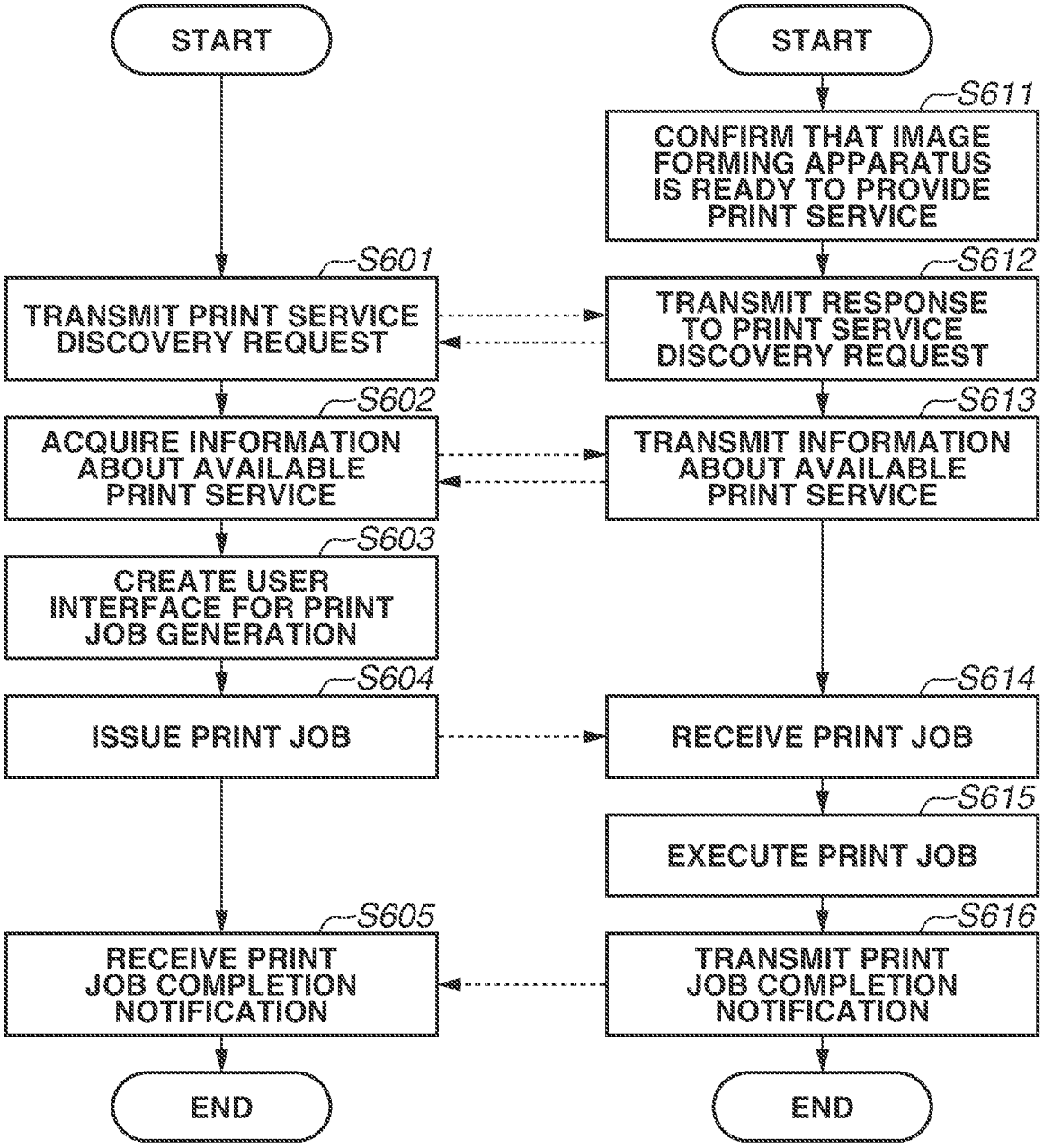
FIG. 7 is a diagram illustrating a print service sequence according to the exemplary embodiment.

FIG. 7 illustrates a sequence of execution of a print service by the system according to the present exemplary embodiment. In FIG. 7, processing in steps S601 to S605 is performed by the PC 50, and processing in steps S611 to S616 is performed by the image forming apparatus 40. In FIG. 7, each broken-line arrow indicates transmission or reception of data. The processing in the steps illustrated in FIG. 7 is implemented by the CPU 501 of the PC 50 or the CPU 401 of the image forming apparatus 40 reading a stored program and executing the program. The sequence is started in a case where a user is to perform printing.

In step S611, after power-on, the image forming apparatus 40 confirms that the image forming apparatus 40 is ready to print, and then shifts to a standby state where the image forming apparatus 40 is ready to provide a print service.

Meanwhile, in step S601, the PC 50 performs a print service discovery (transmits a print service discovery request). The print service discovery may be a search for a peripheral device based on a user's operation or may be a periodic search for an image forming apparatus that is ready to provide a print service. Alternatively, the PC 50 may transmit an inquiry when connected to the image forming apparatus 40.

In step S612, in response to the print service discovery request from the PC 50, the image forming apparatus 40 transmits a notification that the image forming apparatus 40 is ready to provide a print service.

In step S602, in response to the notification from the image forming apparatus 40 that the image forming apparatus 40 is ready to provide a print service, the PC 50 transmits to the image forming apparatus 40 a request for information about an available print service.

In step S613, in response to the request for information about an available print service from the PC 50, the image forming apparatus 40 notifies the PC 50 of information about the print service that the image forming apparatus 40 is ready to provide.

In step S603, upon receiving from the image forming apparatus 40 the information about an available print service, the PC 50 creates a user interface for print job generation based on the received information. More specifically, based on the information about an available print service transmitted from the image forming apparatus 40, setting items such as print image designation, print size, and printable sheet size are appropriately displayed and options for the items are appropriately provided to the user via a display (not illustrated). Then, settings are received from the user via an input device (not illustrated) such as a keyboard.

In step S604, the PC 50 issues a print job based on the settings received from the user and transmits the print job to the image forming apparatus 40.

In step S614, the image forming apparatus 40 receives the print job from the PC 50.

In step S615, the image forming apparatus 40 analyzes the print job and performs printing.

In step S616, upon completion of the printing, the image forming apparatus 40 transmits a printing completion notification to the PC 50. The image forming apparatus 40 then ends the processing and shifts to the standby state.

In step S605, the PC 50 receives the printing completion notification and notifies the user of the completion. Then, the PC 50 ends the processing.

While the example of communication in which requests for various pieces of information are transmitted from the PC 50 to the image forming apparatus 40 and the image forming apparatus 40 responds to the requests has been described above, the communication is not limited to the pull-type communication described above and may be the push-type communication in which the image forming apparatus 40 proactively communicates with the single PC 50 or a plurality of the PCs 50 on a network.

[Heating Pulse]

Figure 8:
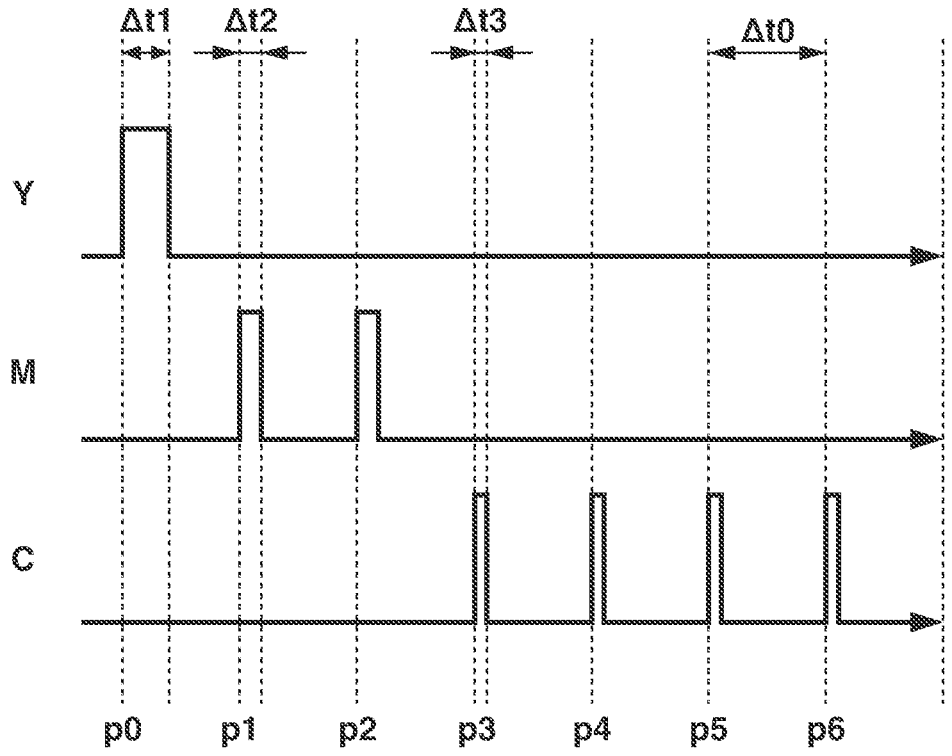
FIG. 8 is a diagram illustrating examples of signal patterns to be applied to the print head according to the exemplary embodiment.

FIG. 8 illustrates an example of a signal pattern (a heating pulse) for each color to be applied to the print head 30 of the image forming apparatus 40. FIG. 8 illustrates an example of each color to be developed on the image forming member 10 and an example of the heating pulse for developing the color in one pixel. FIG. 8 illustrates yellow (Y), magenta (M), and cyan (C) in this order from the top. In FIG. 8, the heating pulse for one pixel includes seven sections (p0 to p6), and each of the sections has a length of a time Δt0. More specifically, the time of the heating pulse for forming one pixel corresponds to the time Δt0×the seven sections (p0 to p6). In color development for one pixel, the number of pulse cycles in the seven sections is used, and a pulse signal train contained therein controls the color development.

In FIG. 8, each signal indicates two values that are High and Low (ON and OFF). Heating by the resistors 34 is performed at the value High and is not performed at the value Low. The color development is controlled by controlling the pulse width and number of pulses contained in the heating pulse for each color. In the present exemplary embodiment, the pulse width of each pulse is adjusted by pulse width modulation (PWM) control. As illustrated in FIG. 8, the starting point of each of the sections will be described as a pulse rise timing (ON timing).

For example, in a case where the yellow (Y) color is developed, heating is performed for a heating time Δt1 to obtain the region 21 of FIG. 2 (which represents a relatively high heating temperature and a relatively short heating time). In a case where the magenta (M) color is developed, heating is performed for a heating time Δt2 twice in total with an interval therebetween to obtain the region 22 of FIG. 2 (which represents an intermediate heating temperature and an intermediate heating time). The interval between the first pulse and the second pulse is the time Δt0−the heating time Δt2. Similarly, in a case where the cyan (C) color is developed, heating is performed for a heating time Δt3 four times in total with an interval therebetween to obtain the region 23 of FIG. 2 (which represents a relatively low heating temperature and a relatively long heating time). The interval between the first pulse and the second pulse is the time Δt0−the heating time Δt3. Provision of the intervals prevents the temperature of the image forming member 10 from exceeding the target temperature (the activation temperature). In other words, the target temperature is maintained by controlling the ON time and the OFF time.

In FIG. 8, in order to facilitate understanding, the relation of Δt1=Δt2×2=Δt3×4 is established, and the total time of the heating pulse to be applied to the print head 30 in the color development of each color is the same. Heating times t1 to t3 to be described next correspond to those in FIG. 2.

Regarding the heating times, the relation of $t2>\Delta t1$ for $Y>t1$, the relation of $t3>\Delta t2$ for $M+\Delta t0>t2$, and the relation of $\Delta t3$ for $C+\Delta t0\times 3>t3$ are satisfied, and the relative heating time relationship is $Y<M<C$.

[Multiplexing Processing Unit]

The multiplexing processing unit 407 generates a multiplex image by embedding additional information in an image. A method for embedding information will be described next with reference to FIGS. 6, 9A, 9B, 10A, and 10B.

The image information A input via the input terminal 100 in FIG. 6 is multi-gradation image data containing color components. The image data is data for recording an image so that, in a case where the image is output as the recorded product C, the user who views the recorded product C recognizes the image. The multiplexed information B input via the input terminal 101 in FIG. 6 is text document data, audio data, moving image data, data generated by compressing text document information, audio information, an image, or moving image information, data converted into another binary value, or the like. The multiplexed information B is data to be recorded so that it is hard for the user to visually recognize the multiplexed information B embedded in the image when viewing the image output as the recorded product C.

The multiplexing processing unit 407 performs processing for embedding the multiplexed information B in the image information A. In the present exemplary embodiment, the image information A, which is red-green-blue (RGB) data transmitted from the PC 50 is converted into cyan-magenta-yellow (CMY) data that enables color development of the image forming layers 14, 16, and 18, and the multiplexed information B is embedded in this CMY data. The processing is not limited thereto as long as multiplexing is performed before recording data generation. For example, the multiplexed information B may be embedded in the RBG data.

To process information in an information processing apparatus such as the PC 50 is to process binary data. Binary data is information of "0" or "1", and a sequence of the information of "0" or "1" indicates a specific meaning. For example, in a case where the text "hello" is processed as binary data according to, for example, a character encoding "Shift Japanese Industrial Standards (Shift_JIS)", the letter "h" corresponds to the binary data "01101000". Similarly, the letter "e" corresponds to the binary data "01100101", the letter "1" corresponds to the binary data "01101100", and the letter "o" corresponds to the binary data "01101111". Accordingly, the text "hello" is expressed as the binary data "0110100001100101011011000110110001101111". Reversely, if the binary data "0110100001100101011011000110110001101111" is acquired, the text "hello" can be acquired. Based on this idea, the multiplexed information B can be acquired by performing multiplexing and embedding data so that the information "0" and the information "1" are determinable.

FIGS. 9A and 9B illustrate two mask patterns as masks for generating the information "0" and the information "1", respectively. Each of the masks illustrated in FIGS. 9A and 9B is formed of 8×8 pixels. Adding the content of the mask to the image information A makes it possible to provide a pattern with periodicity to the 8×8 pixel region in the image. Basically, each color of a digital image is expressed by 8 bits, and a value in the range of 0 to 255 is assigned to each color. A value outside the range cannot be used for image data, so that in a case where a pixel value calculation result indicates a value less than 0 or a value equal to or greater than 256, a value of 0 or 255 is generally assigned so that the resulting value is within the valid range. In each of the masks illustrated in FIGS. 9A and 9B, a pixel value is changed by plus or minus 10, but in a case where every value of image data in the mask region is 255, the value range of the image data in the region is not from 245 to 265 but from 245 to 255. As described above, 1-bit information can be embedded in the 8×8 pixel region. In a case where a plurality of pieces of information is to be embedded, the information can be embedded into 8×8 pixel regions corresponding to the number of bits of the information to be embedded. While the case where one color is expressed by 8 bits has been described above, the number of bits other than eight can be employed to express one color. In digital image processing, there is a valid range regardless of how many bits are used to express one color, and any change not satisfying the valid range cannot be made. In addition, a region for embedding 1-bit information may not be an 8×8 pixel region. Furthermore, the number of pixels in the vertical direction may not be the same as the number of pixels in the horizontal direction.

Figure 10A:
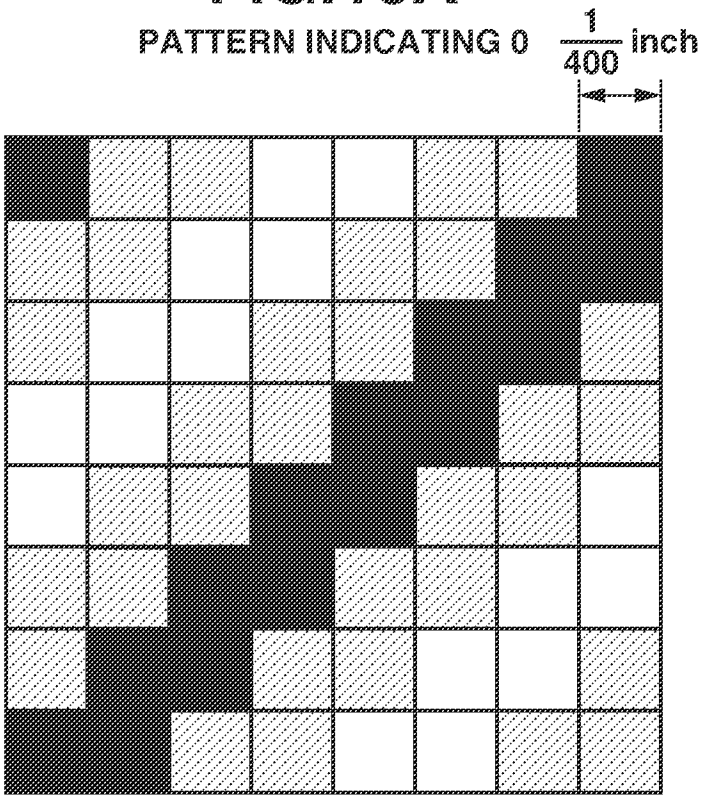
FIGS. 10A and 10B are diagrams each illustrating a pattern to be provided for multiplexing according to the exemplary embodiment.
Figure 10B:
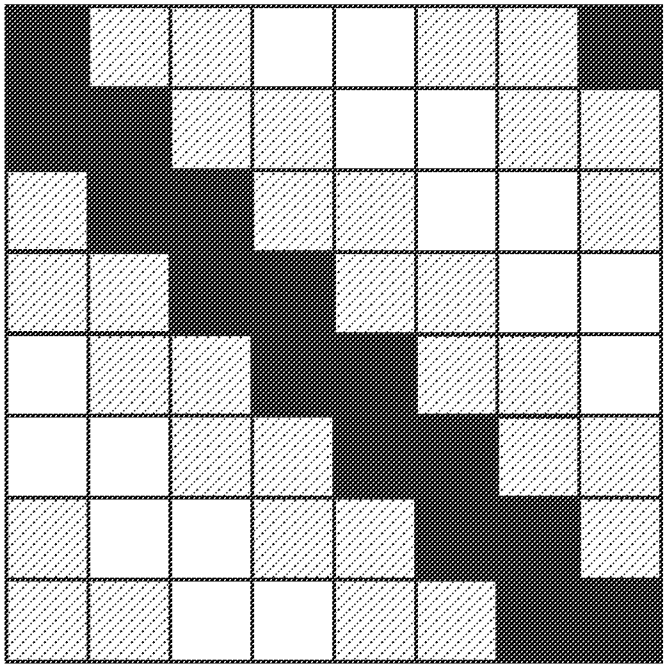

FIGS. 10A and 10B visually illustrate patterns provided to an image using the masks of FIGS. 9A and 9B. Each position corresponding to the value "10" in the masks of FIGS. 9A and 9B is expressed in black, each position corresponding to the value "0" in the masks is expressed in gray, and each position corresponding to the value "−10" in the masks is expressed in white. As a result, oblique lines appear in the image as illustrated in FIGS. 10A and 10B.

The pseudocode for alternately applying the masks of FIGS. 9A and 9B to the entire image will be described next.

```
int i,j,k,l;
int width=640, height=480;
unsigned char *data=image data;
int **maskA=mask data;
bool isMaskA=true;
for(j=0;j<height;j+=8){
    for(i=0;i<width;i+=8){
        for(k=0;k<8;k++){
            for(l=0;l<8;l++){
                if(isMaskA==true){
                    data[(i+k)+(j+l)*width]+=maskA[k][l];
                }
        }
        }
    }
}
```

Using the foregoing method enables information to be embedded by multiplexing.

The image information A to which the multiplexed information B is added as described above is processed by the recording data generation unit 408 to generate recording data. The print head 30 forms an image on the image forming member 10 based on the recording data and outputs the recorded product C. Referring to FIGS. 10A and 10B, it is understood that each of the patterns is drawn by a 2-pixel oblique line. Thus, to use these masks to generate the recorded product C in which the multiplexed information B is embedded, the image forming apparatus 40 is expected to be accurate enough to precisely reproduce the 2-pixel line. In a case where the print resolution of the image forming apparatus 40 is 400 dpi (dots per inch), the width of the printed oblique line is 2/400 inches.

Apparently, the image forming apparatus 40 is expected to have a frequency response characteristic that is high enough to reproduce the width of the oblique line. The frequency response characteristic of the image forming apparatus 40 herein refers to a frequency response characteristic for an image of the colors to be developed in the image forming layers 14, 16, and 18.

The processing of generating the recorded product C based on the image information A in which the multiplexed information B is embedded as described above is also referred to as "multiplexing encoding processing".

[Multiplexing Decoding Processing Unit]

Figure 11:
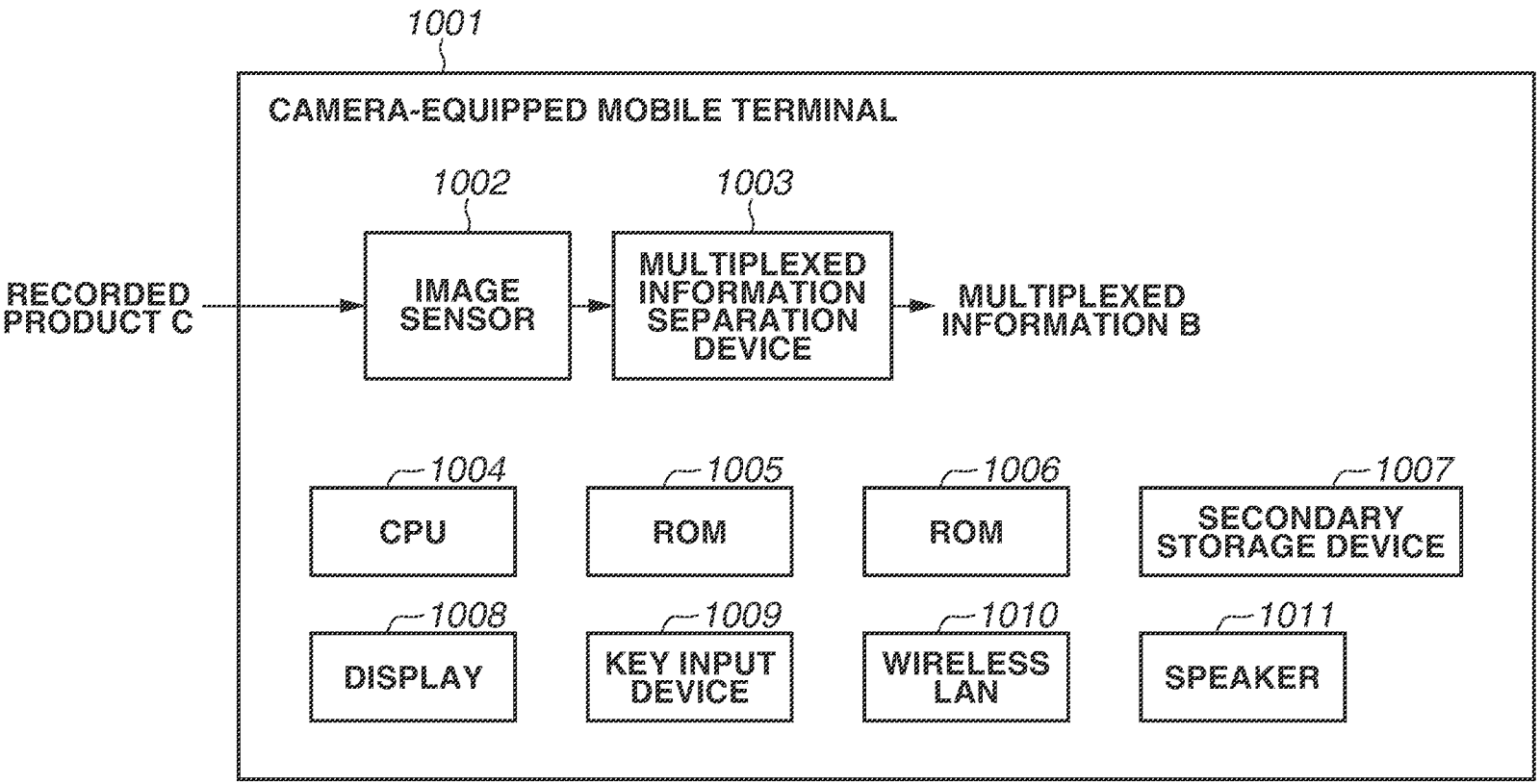
FIG. 11 is a diagram illustrating a configuration of hardware for multiplexing decoding according to the exemplary embodiment.

FIG. 11 illustrates an example of a configuration of hardware (a multiplexing decoding processing unit) for multiplexing decoding that extracts the multiplexed information B from the image information A recorded in the recorded product C. The hardware captures an image of the recorded product C subjected to the multiplexing encoding processing, using an image capturing apparatus such as a camera and analyzes the captured image to extract the multiplexed information B embedded in the image.

In FIG. 11, a camera-equipped mobile terminal 1001 including an image sensor 1002 has a function of capturing an image of the recorded product C. A multiplexed information separation device 1003 analyzes the image captured by the image sensor 1002 to extract the multiplexed information B as described below. A CPU 1004 performs information processing based on a program, and a ROM 1005 stores a program to be executed by the CPU 1004. A RAM 1006 functions as a memory that temporarily stores various types of information during the execution of the program by the CPU 1004. A secondary storage device 1007 such as a hard disk stores an image file of the image captured by the image sensor 1002, a database containing image analysis results, and the like. A display 1008 presents a result of processing by the CPU 1004 to the user. A key input device 1009 enables the user to input processing instructions and characters while performing a touch panel operation using the display 1008 having a touch panel function. A wireless LAN 1010 connects to the Internet and accesses a site connected to the Internet to display a screen of the site on the display 1008. The wireless LAN 1010 is also used to transmit and receive data. A speaker 1011 outputs sound in a case where the extracted multiplexed information B is audio data or audio-added moving image data. In addition, in a case where there is moving image data in the connection destination on the Internet, the speaker 1011 outputs sound during reproduction of the moving image data.

The configuration of the camera-equipped mobile terminal 1001 is not limited to the configuration including the image sensor 1002 therein. For example, an image captured by another image capturing apparatus different from the camera-equipped mobile terminal 1001 may be transmitted to the multiplexed information separation device 1003 of the camera-equipped mobile terminal 1001. The image sensor 1002 can be a digital camera or a video camera, and the multiplexed information separation device 1003 can be a PC or a smartphone and is configured to extract the multiplexed information B from the recorded product C. The method of extracting the multiplexed information B from the recorded product C is also hereinafter referred to as "multiplexing decoding processing".

[Image Printing Method]

As described in the section [Multiplexing Processing Unit], in order to perform multiplexing, the image forming apparatus 40 is expected to have a frequency response characteristic that is high enough to precisely reproduce thin lines like those illustrated in FIGS. 10A and 10B.

In thermal printing using thermal paper, since the heating times for developing the colors of the image forming layers 14, 16, and 18 are different from one another as illustrated in FIG. 2, the frequency response characteristic varies depending on the image forming layer.

Figure 12A:
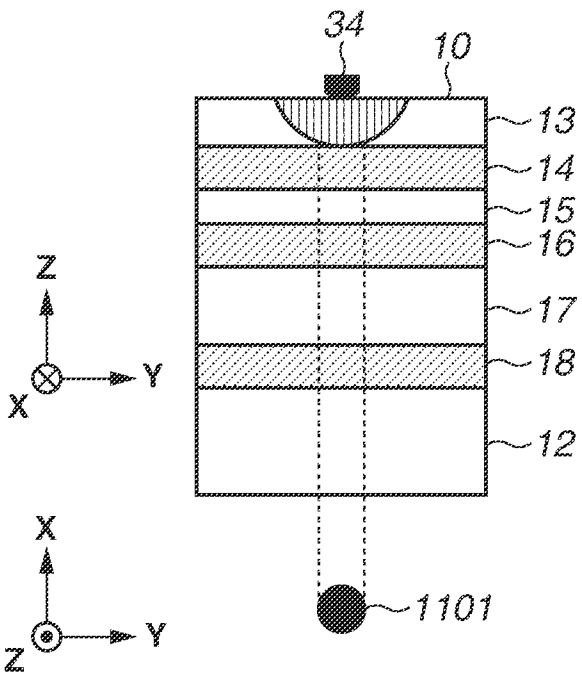
FIGS. 12A to 12C are diagrams each illustrating an example of a color development region of the image forming member according to the exemplary embodiment.
Figure 12B:
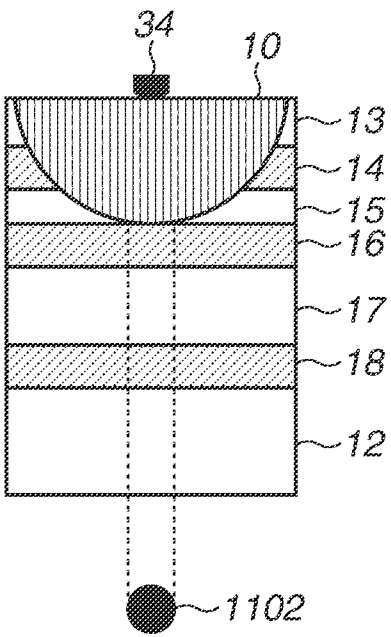
Figure 12C:
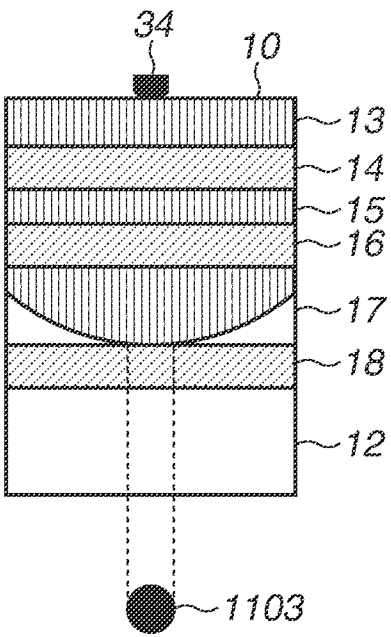

FIGS. 12A to 12C illustrate color development regions in a case where the resistors 34 heat the image forming member 10 to develop the colors of the image forming layers 14, 16, and 18. In each of FIGS. 12A to 12C, the upper diagram is a side view (on −X side) of the image forming apparatus 40, and the lower diagram is a top view (on +Z side) of the image forming member 10 in a heated state. The shaded region indicates a region to which a sufficient temperature for developing the color of the corresponding image forming layer is transferred. Color development regions 1101, 1102, and 1103 are regions where the colors of the image forming layers 14, 16, and 18 are developed, respectively. The color development regions 1101, 1102, and 1103 generally have a circular or elliptic shape, depending on the shape of the resistors 34.

Figure 13A:
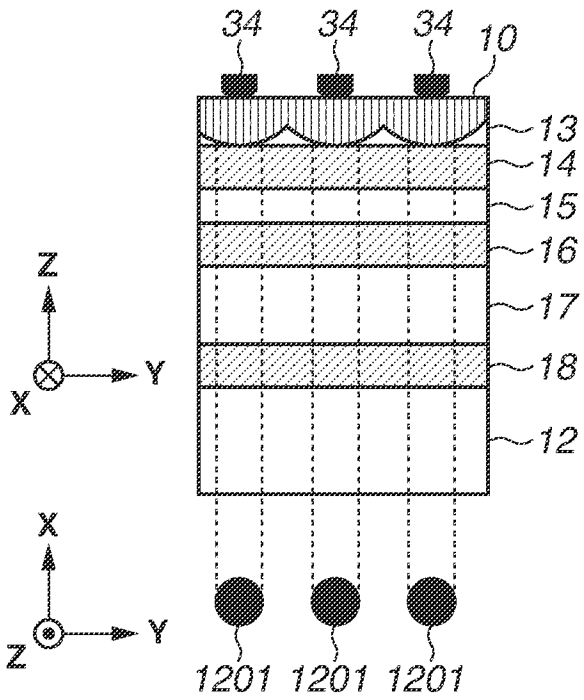
FIGS. 13A to 13C are diagrams each illustrating another example of the color development region of the image forming member according to the exemplary embodiment.
Figure 13B:
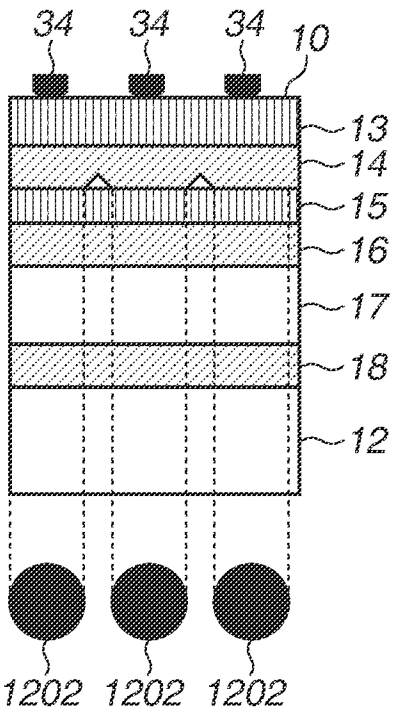
Figure 13C:
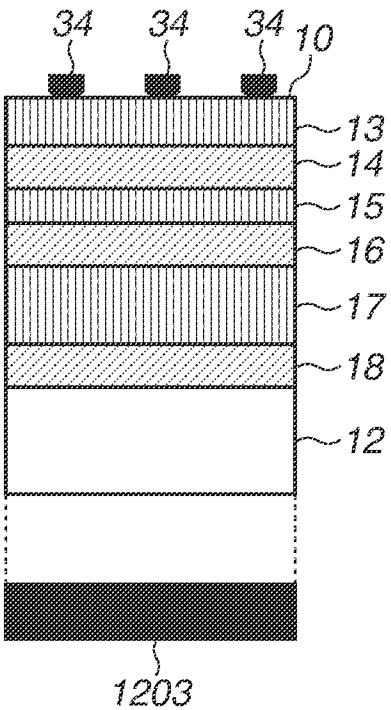

FIGS. 13A to 13C illustrate color development regions in a case where whether to perform high-frequency heating is switched. FIGS. 13A to 13C each illustrate a heated state of the image forming member 10 that is heated three times by one of the resistors 34 while being conveyed in the Y-direction. In each of FIGS. 13A to 13C, the upper diagram is the side view (on −X side) of the image forming apparatus 40, and the lower diagram is the top view (on +Z side) of the image forming member 10 in a heated state. Color development regions 1201, 1202, and 1203 are regions where the colors of the image forming layers 14, 16, and 18 are developed by high-frequency heating, respectively. Referring to the color development regions 1201 in developing the color of the image forming layer 14 in FIG. 13A, the color development regions in three heating operations are separately formed as in FIG. 12A, and the color of the image forming layer 14 is successfully developed by high-frequency heating so that a heating region for each pixel is recognizable. The color development regions 1202 in developing the color of the image forming layer 16 in FIG. 3B is larger than the color development regions 1201 in developing the color of the image forming layer 14. Since the heating time for developing the color of the image forming layer 16 is longer than the heating time for developing the color of the image forming layer 14, a larger area is heated in the image forming layer 16. In high-frequency heating, a next pixel to be formed is close to a previously-formed pixel, and a portion of the image forming layer 16 to be heated to form the next pixel has already been heated in forming the previous pixel. Since the portion has already been heated, heat is easily conducted through the portion. Thus, the area where the color is developed is larger in the image forming layer 16 than in the image forming layer 14. Accordingly, the distance between the adjacent color development regions is smaller in the image forming layer 16 than in the image forming layer 14. In FIG. 13C, since the heating time is longer than that in FIG. 13B, in high-frequency printing, heating is conducted almost continuously, and the color development region 1203 where the color is developed by high-frequency heating is the entire region of the image forming layer 18. In other words, the color development region 1203 is not separated on a pixel-by-pixel basis. As described above, the frequency response characteristic varies depending on the image forming layer.

A conventional image forming apparatus such as an inkjet printer has substantially the same high frequency response characteristic for inks of different colors, and thus embeds the multiplexed information B using the inks of all colors. On the contrary, in thermal printing using thermal paper, since the frequency response characteristic varies depending on the image forming layer, the multiplexed information B may not be embedded readably in a case where the frequency response characteristic for any of the colors is not high enough to embed the multiplexed information B.

As a solution to the above-described issue, in the present exemplary embodiment, the color of an image forming layer for which the frequency response characteristic is high is mainly used in recording the multiplexed information B. Using the color of such an image forming layer in a large amount increases recording accuracy for high-frequency patterns, so that the multiplexed information B is readably recorded. In the present exemplary embodiment, the image forming layer for which the frequency response characteristic is high refers to the image forming layer that causes color development at a high temperature in a short heating time and is at a shallow depth from the surface of an image forming member. More specifically, in the image forming member 10 illustrated in FIG. 1, the image forming layer 14 for developing the yellow color is the image forming layer that causes color development at the highest temperature in the shortest heating time and is at the shallowest depth from the surface of the image forming member 10.

While the example in which each of the image forming layer 14 for developing the yellow color and the image forming layer 16 for developing the magenta color is a separate color development layer in which the color development region corresponding to one pixel and the color development region corresponding to a pixel adjacent to the one pixel are separate from each other has been described above with reference to FIGS. 12A to 12C and 13A to 13C, another method in which the color development region corresponding to one pixel is not separate from the color development region corresponding to a pixel adjacent to the one pixel may be used as long as a multiplex pattern is readable. In a case where patterns indicating "0" and "1" as illustrated in FIGS. 10A and 10B are embedded, pixels having the value "+10", pixels having the value "+0", and pixels having the value "−10" in the masks are respectively arranged in pairs of two pixels in each of the vertical and horizontal directions. In the present exemplary embodiment, lines of the pixels having the value "+10", lines of pixels having the value "+0", and lines of the pixels having the value "−10" are recorded so as to be readable from a captured image. For this reason, the multiplexed information B cannot be embedded readably in a color development layer in which application of energy for developing the color of the pixels having the value "+10" causes development of the color of all the pixels having the value "−10" that are adjacent to and separated by two pixels from the pixels having the value "+10". In a case where such patterns as illustrated in FIGS. 10A and 10B are embedded, if a color development region in developing the color of one target pixel is within a region covering the pixels adjacent to the target pixel, the multiplexed information B is readably recorded. For example, assuming that the diameter of a maximum dot that fits in a region corresponding to one pixel is 1, the diameters of the color development dots of the image forming layers 14, 16, and 18 for developing the yellow, magenta, and cyan colors are 1.5, 2, and 4, respectively. The image forming layers that allow the patterns to be readably recorded are the image forming layer 14 for developing the yellow color and the image forming layer 16 for developing the magenta color. Furthermore, the image forming layer 14 for developing the yellow color that is shorter in heating time for color development than the image forming layer 16 for developing the magenta color allows the patterns to be recorded in a more readable manner.

An example of embedding the multiplexed information B in the image forming layer 14 will be described next.

To embed the multiplexed information B using the image forming layer 14 that causes color development in the shortest heating time, the image data is divided to correspond to the colors to be developed in the image forming layers 14, 16, and 18. In the present exemplary embodiment, the image data is divided into yellow, magenta, and cyan components.

After the image data is divided into the CMY-components, the Y-component data is changed to perform multiplexing. A known method can be used to change the Y-component data. For example, the Y-component data can be changed by directly adding or subtracting the values in the masks as illustrated in FIGS. 9A and 9B, or by adding or subtracting reference values multiplied by the values in the masks. The method is not particularly limited and any method capable of embedding the patterns indicating "0" and "1" in the Y-component can be employed. For example, the case of directly adding or subtracting the values in the masks as illustrated in FIGS. 9A and 9B is expressed by the following formula (3).

$$Y \text{ value after application of mask} = Y \text{ value of } CMY \text{ data} + \text{value in mask} \quad (3)$$

For example, in a case where the Y value of one pixel is "60" and the corresponding value in the mask to be applied is "+10", the Y value is processed as expressed by the following formula (4).

$$Y \text{ value after application of mask} = 60 + (+10) = 70 \quad (4)$$

In the present exemplary embodiment, the color of the image forming layer 14 that causes color development in the shortest heating time is changed to embed the multiplexed information B therein. However, depending on the original colors of the image data subject to multiplexing, the change in the color of the image forming layer 14 for embedding the multiplexed information B therein may be prominent.

In this case, adjustment processing is performed to change the colors of the other image forming layers 16 and 18 so that the color change is less prominent. For example, in a case where the yellow color is changed in contrast to a color with low brightness, increased brightness caused by adding the yellow color is noticeable to human eyes, and the color change is prominent. In this case, the values of the magenta and cyan colors in the image are also changed so as to correspond to the change to the yellow color, so that the increase in brightness becomes a change in saturation and becomes less prominent to human eyes.

Furthermore, the color change may be less prominent in a case where the color of the image forming layer 16 that has the second shortest color development time is developed to embed the multiplexed information B therein than in a case where the color of the image forming layer 14 is developed to embed the multiplexed information B therein. In this case, the color of the image forming layer 16 can be developed to embed the multiplexed information B therein. The image forming layer in which the multiplexed information B can be embedded is the image forming layer where the pixels that develop colors in image printing are separated from each other. Among the image forming layers 14, 16, and 18 described above, the multiplexed information B can be embedded in the image forming layers 14 and 16 but cannot be embedded in the image forming layer 18. The farther the color development circles are from each other, the easier the extraction of the multiplexed information B is in multiplexing decoding processing. Thus, in one embodiment, the image forming layer 14 is used more than the image forming layer 16 in embedding the multiplexed information B from the point of view of multiplexing decoding processing.

While the case where the colors of the image forming layers 14, 16, and 18 are yellow, magenta, and cyan, respectively, has been described in the present exemplary embodiment, even in a case where the order of the colors is changed, the image forming layer that causes color development in the shortest heating time is mainly used to embed the multiplexed information B. For example, in a case where the image forming layers 14, 16, and 18 are configured to develop the magenta, cyan, and yellow colors, respectively, the magenta color is used to embed the multiplexed information B.

Furthermore, the colors to be developed in the image forming layers 14, 16, and 18 may be colors other than yellow, magenta, and cyan, e.g., red, green, and blue. Also in this case, the image forming layer that causes color development in the shortest heating time is used to embed the multiplexed information B.

While the case where the image forming layer that causes color development in the shortest heating time allows the color to be developed sufficiently by high-frequency heating has been described in the above-described exemplary embodiment, there may a case where there is a plurality of image forming layers that allows the colors to be developed sufficiently by high-frequency heating. In a case where the plurality of image forming layers allows the colors to be developed sufficiently by high-frequency heating, the plurality of image forming layers may be used to embed the multiplexed information B.

As described above, the color of the image forming layer that causes color development in the shortest heating time is used to embed multiplexed information, so that the multiplexed information can be embedded even in a case where the frequency response characteristic for a portion of the image forming layers is not high enough to embed the multiplexed information.

The above-described exemplary embodiment provides the beneficial effect that an image in which additional information is embedded can be recorded on an image forming member that includes a plurality of color development layers having different color development characteristics so that the additional information is readable from the recorded image.

OTHER EMBODIMENTS

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-164107, filed Sep. 29, 2020, which is hereby incorporated by reference herein in its entirety.

What is claimed is:

1. An apparatus comprising:

a generation unit configured to generate image data for recording by a forming apparatus configured to form an image on a forming member using a print head configured to apply energy to the forming member, the forming member including a plurality of color development layers each having a different color development characteristic and configured to cause color development depending on the applied energy; and a multiplexing unit configured to perform multiplexing processing to generate recording data in which predetermined information to be recognized by a reading apparatus as information different from an image to be recorded on the forming member is embedded in the image data representing the image, wherein the multiplexing unit generates the recording data so that the predetermined information is recorded by the color development of at least the color development layer that causes color development of a dot of one pixel in a shortest time among the plurality of color development layers in a case where the print head applies the energy to the forming member, and wherein the multiplexing unit generates the recording data so that the color development layers other than the color development layer in which the predetermined information is to be recorded also cause the color development based on the predetermined information.

2. The apparatus according to claim 1, wherein the color development layer that causes the color development in the shortest time is the color development layer that develops a yellow color.

3. The apparatus according to claim 1, wherein the color development layer that causes the color development in the shortest time is the color development layer that is heated to a highest temperature to cause the color development, among the plurality of color development layers.

4. The apparatus according to claim 1, wherein the color development layer that causes the color development in the shortest time is the color development layer closest to the print head, among the plurality of color development layers.

5. The apparatus according to claim 1, wherein the multiplexing unit generates the recording data so that the predetermined information is recorded by the color development of the plurality of color development layers.

6. The apparatus according to claim 1, wherein the multiplexing unit generates the recording data by changing a value of the image data based on the predetermined information.

7. The apparatus according to claim 1, wherein the image data is data to be recorded so as to be visually recognizable by a user.

8. The apparatus according to claim 1, further comprising the print head.

9. An apparatus comprising:

a generation unit configured to generate image data for recording by a forming apparatus configured to form an image on a forming member using a print head configured to apply energy to the forming member, the forming member including a plurality of color development layers each having a different color development characteristic and configured to cause color development depending on the applied energy; and a multiplexing unit configured to perform multiplexing processing to generate recording data in which predetermined information to be recognized by a reading apparatus as information different from an image to be recorded on the forming member is embedded in the image data representing the image, wherein the multiplexing unit generates the recording data so that the predetermined information is recorded by the color development of at least a separate color development layer, among the plurality of color development layers, in the recording on the forming member based on the recording data by the forming apparatus using the print head, the separate color development layer being configured to form a color development region corresponding to one pixel and a color development region corresponding to a pixel adjacent to the one pixel separately from each other, and wherein the multiplexing unit generates the recording data so that the color development layers other than the color development layer in which the predetermined information is to be recorded also cause the color development based on the predetermined information.

10. The apparatus according to claim 9, wherein the separate color development layer in which the predetermined information is to be recorded includes the color development layer that causes the color development in a shortest time in a case where the print head applies the energy to cause the color development of each of the color development layers.

11. The apparatus according to claim 10, wherein the color development layer that causes the color development in the shortest time is the color development layer that develops a yellow color.

12. The apparatus according to claim 9, wherein the multiplexing unit generates the recording data so that the predetermined information is recorded by the color development of a plurality of the separate color development layers.

13. The apparatus according to claim 9, wherein the multiplexing unit generates the recording data by changing a value of the image data based on the predetermined information.

14. The apparatus according to claim 9, wherein the image data is data to be recorded so as to be visually recognizable by a user.

15. The apparatus according to claim 9, further comprising the print head.

16. A method comprising:

generating recording data for recording on a forming member that includes a plurality of color development layers each having a different color development characteristic and configured to cause color development depending on energy applied by a print head;

recording an image with the energy applied to the forming member by the print head based on the recording data; and performing multiplexing processing to generate recording data in which predetermined information to be recognized by a reading apparatus as information different from an image to be recorded on the forming member is embedded in image data representing the image, wherein the recording records the predetermined information on the forming member by causing the color development of at least the color development layer that causes the color development in a shortest time among the plurality of color development layers, with the energy applied to the forming member by the print head based on the recording data; and wherein the multiplexing processing generates the recording data so that the color development layers other than the color development layer in which the predetermined information is to be recorded also cause the color development based on the predetermined information.

17. A method comprising:

generating recording data for recording on a forming member that includes a plurality of color development layers each having a different color development characteristic and configured to cause color development depending on energy applied by a print head;

recording an image with the energy applied to the forming member by the print head based on the recording data; and performing multiplexing processing to generate recording data in which predetermined information to be recognized by a reading apparatus as information different from an image to be recorded on the forming member is embedded in image data representing the image, wherein the recording records the predetermined information on the forming member by causing the color development of at least a separate color development layer, among the plurality of color development layers, with the energy applied to the forming member by the print head based on the recording data, the separate color development layer being configured to form a color development region corresponding to one pixel and a color development region corresponding to a pixel adjacent to the one pixel separately from each other in a case where the print head applies the energy to the forming member to record the image; and wherein the multiplexing processing generates the recording data so that the color development layers other than the color development layer in which the predetermined information is to be recorded also cause the color development based on the predetermined information.

18. The method according to claim 16, wherein the image recorded on the forming member is captured by the reading apparatus, the predetermined information embedded in the captured image is extracted from the captured image, and a user is notified of the extracted predetermined information.

* * * * *